US010842248B2

(12) United States Patent
Ishayik

(10) Patent No.: US 10,842,248 B2
(45) Date of Patent: Nov. 24, 2020

(54) INFLATION NEEDLE HOLDER

(71) Applicant: Michael Ishayik, La Jolla, CA (US)

(72) Inventor: Michael Ishayik, La Jolla, CA (US)

( * ) Notice: Subject to any disclaimer, the term of this patent is extended or adjusted under 35 U.S.C. 154(b) by 0 days.

(21) Appl. No.: 16/123,506

(22) Filed: Sep. 6, 2018

(65) Prior Publication Data

US 2020/0077774 A1 Mar. 12, 2020

(51) Int. Cl.
*A45F 5/00* (2006.01)
*A45C 11/00* (2006.01)
*A63B 41/12* (2006.01)

(52) U.S. Cl.
CPC ..... *A45F 5/00* (2013.01); *A45C 11/00* (2013.01); *A63B 41/12* (2013.01)

(58) Field of Classification Search
CPC ..... A45F 5/00; A45C 11/00; A63B 41/12
USPC ..... 206/205–207, 349–383
See application file for complete search history.

(56) References Cited

U.S. PATENT DOCUMENTS 247,988 A * 10/1881 Cookingham ..... B65D 85/24 206/380
3,248,167 A * 4/1966 Friedman ..... A61C 3/04 206/350
4,415,092 A * 11/1983 Boyer ..... B43K 23/001 211/59.2
4,503,972 A * 3/1985 Nelligan ..... B25H 3/003 206/369
5,671,844 A * 9/1997 Sircy ..... A63B 47/00 206/315.1
5,902,275 A * 5/1999 Dobkin ..... A61M 25/02 128/DIG. 26
6,474,482 B2 * 11/2002 Manix ..... A47B 81/00 211/70.6
6,997,334 B2 * 2/2006 Manix ..... A45C 11/00 206/380
7,134,550 B2 * 11/2006 Groth ..... A61M 5/002 206/366
8,079,487 B2 * 12/2011 Roesler ..... B25H 3/023 206/349
2002/0066707 A1 * 6/2002 Manix ..... A47B 81/00 211/70.6
2009/0188931 A1 * 7/2009 Liu ..... B25H 3/022 220/735

* cited by examiner

*Primary Examiner* — Chun Hoi Cheung
(74) *Attorney, Agent, or Firm* — Ellenoff Grossman & Schole LLP; James M. Smedley; Alex Korona

(57) ABSTRACT

The present invention generally relates to a storage device. Specifically, an inflation needle holding device comprising a compliant base member, having one or more receiving holes for the storage of one or more inflation needles.

20 Claims, 1 Drawing Sheet

INFLATION NEEDLE HOLDER

FIELD OF THE INVENTION

The present invention generally relates to a storage device. Specifically, an inflation needle holding device comprising a compliant base member, having one or more receiving holes for the storage of one or more inflation needles.

BACKGROUND

Inflation needles are commonly used to inflate certain sports balls, tires, mattresses, and similar inflatable objects. Inflation needles generally attach to one end of a pump or a hose attached to a pump, such as a hand pump or air compressor.

Inflation needles are generally small metal or plastic pieces that, while being integral to the process of inflating inflatable objects, are easily lost or misplaced due to their size. There is, therefore, a need in the art for an inflation needle holding device. Embodiments of the present invention may solve this need by providing an inflation needle holding device comprised of a pliable material having the ability to secure and store inflation needles and allow for the easy insertion and removal of inflation needles from the base of the inflation needle storing device.

SUMMARY OF THE INVENTION

The present invention is an inflation needle storing device and a method of manufacture and use thereof. In some embodiments, the storage device is primarily comprised of a resilient and pliable material and has the ability to accessibly and conveniently store one or more inflation needle holders.

This invention provides an easy and practical storage device designed to hold inflation needles, making it simple, in one respect, to locate stored inflation needles, and in a second respect, to provide a convenient storage means designed to easily and conveniently expel one or more inflation needles from within the device.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED SPECIFICATION

The present invention generally relates to a storage device for storing inflation needles.

Embodiments of the present invention are generally directed to an inflation needle holding device comprised of a compliant base having the ability to accommodate and store one or more inflation needles.

According to embodiments of the present invention, the compliant base is made of a resilient and pliable material, such as rubber or plastic and the like. In some embodiments, the compliant base has a first and second end, with the first end generally being of a greater width than the second end.

According to embodiments of the present invention, one or more receiving holes are incorporated into the compliant base. In some embodiments, the one or more receiving holes are disposed at the first end of the compliant base. In some embodiments, the one or more receiving holes extend into the compliant base, creating hollow channels within the compliant base. In some embodiments, the hollow channels receive the stem and threaded portion of an inflation needle. In some embodiments, the hollow channels receive inflation needle cylindrical stems.

According to embodiments of the present invention, the first end of the compliant base incorporates a curved orientation in the shape of an arc, crescent or similar semicircular profile. In some embodiments, one or more receiving holes are disposed along the exterior portion of the semicircular profile. In some embodiments, when the compliant base is at rest, the size and shape of each receiving hole disposed along the semicircular profile, and each hollow channel extending therefrom, is slightly smaller than the size and shape of a standard inflation needle, providing a friction fit channel for each individual inflation needle. In some embodiments, when the compliant base is at rest, the diameter of each receiving hole disposed along the semicircular profile, and each hollow channel extending therefrom, is slightly smaller than the diameter of the inflation needle cylindrical stems, providing a friction fit channel for each individual cylindrical stem. When pressure is applied to the uppermost tip and bottommost portion of the semicircular profile, the shape and size of each receiving hole and corresponding hollow channel is briefly and reversibly altered to facilitate the easy and convenient insertion and removal of inflation needles from within the receiving holes and corresponding hollow channels.

According to embodiments of the present invention, the compliant base incorporates a hollow recess, through which a chain, wire, string, or similar hanging means may be retained in order to attach the storage device to a keychain, bag, wall, or any other location desired by the user.

Figure 1:
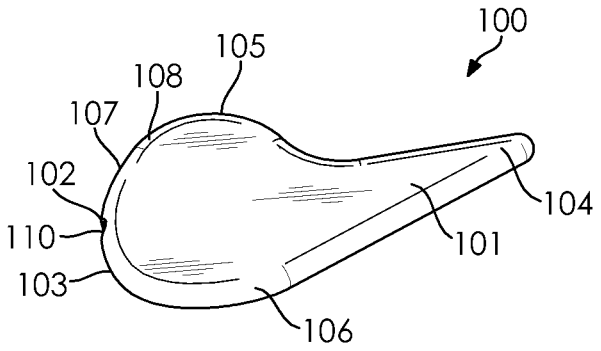
FIG. 1 shows an inflation needle storing device in accordance with the present invention.
Figure 2:
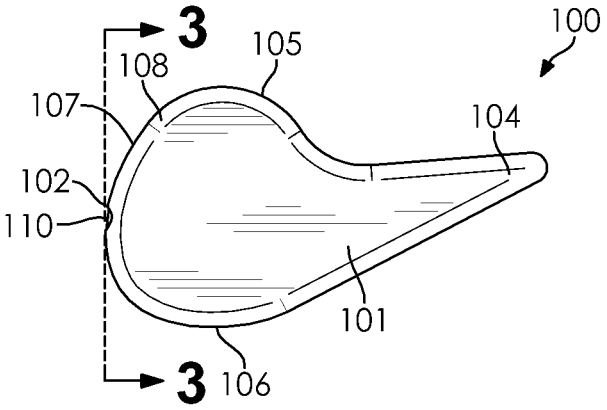
FIG. 2 shows an inflation needle storing device in accordance with the present invention.
Figure 3:
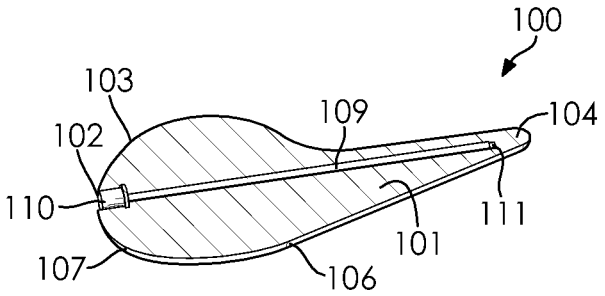
FIG. 3 shows a cross-sectional view of an inflation needle storing device in accordance with the present invention.

Referring now to FIGS. 1-3, an inflation needle holding device, in accordance with an embodiment of the present invention, is shown. In a preferred embodiment, the inflation needle holding device 100 comprises a compliant base 101. The base 101 has at least one inflation needle receiving hole 102. In some embodiments, the receiving hole 102 extends into the base 101 creating hollow channels 111 within the base 101. In some embodiments, inflation needles 110 are received through said at least one receiving hole 102 and into said hollow channels 111. In some embodiments, the base 101 has a first end 103 and a second end 104. In some embodiments, the first end 103 is generally greater in width than the second end 104. In some embodiments, the first end 103 has a curved orientation in the shape of an arc, crescent, or similar semicircular profile 108, having a tip 105 and a bottommost portion 106. In some embodiments, the size and shape of the channels 111 is slightly smaller than the size and shape of standard inflation needles 110, providing a friction fit channel for the needles 110. In some embodiments, the diameter of the channels 111 is slightly smaller than the diameter of inflation needle cylindrical stems 109, providing a friction fit channel for each individual cylindrical stem. In some embodiments, the compliant base includes a hollow recess (not shown) through which a chain, wire, string, or similar hanging means may be retained in order to attach the storage device to a keychain, bag, wall, or any other location desired by the user. In some embodiments, one or more receiving holes 102 are disposed along an exterior portion 107 of the semicircular profile 108 with hollow channels 111 extending therefrom into the base 101 such that applying pressure to the uppermost tip 105 of the semicircular profile 108 and bottommost portion 106 of the semicircular profile 108 briefly, and reversibly, alters the shape and size of each receiving hole 102 and each corresponding hollow channel to facilitate the easy and convenient insertion and removal of inflation needles from within base 101.

Turning now to FIG. 3, a cross-sectional view of an inflation needle holder, in accordance with an embodiment of the present invention, is shown. In a preferred embodiment, one or more receiving holes 102 are disposed along an exterior portion 107 of the semicircular profile 108 with hollow channels 111 extending therefrom into the base 101.

The terminology used herein is for the purpose of describing particular embodiments only and is not intended to be limiting of the invention. As used herein, the term "and/or" includes any and all combinations of one of more of the associated listed items. It will further be understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An inflation needle storage device comprising:

a unitary member forming a resilient, pliable and compliant base having a flat left face and a flat right face connected by an edge having a front portion formed as a curve and top and bottom portions that taper down to meet at a rear portion of said edge;

at least one inflation needle receiving hole disposed on said front edge portion curve and extending into said base to create a hollow channel within said base, said hollow channel able to receive and hold at least a portion of an inflation needle; and a concave flexible joint formed on said top edge portion, between said front and rear edge portions, adapted to flex to enable the expansion of said curve and each receiving hole disposed thereon in proportion to the flexion of said flexible joint; and wherein pressing said top edge portion towards said bottom or rear edge portions flexes said concave flexible joint to increase the curvature of said curve and expands said at least one inflation needle receiving hole.

2. The storage device of claim 1 wherein the hollow channel receives and holds the length and circumference of an inflation needle cylindrical stem.

3. The storage device of claim 1 wherein the hollow channel receives and holds the cylindrical stem and threaded portion of an inflation needle.

4. The storage device of claim 1 wherein the base is made of plastic, rubber, or any similar resilient and pliable material.

5. The storage device of claim 1 wherein a hollow recess is incorporated into the base.

6. An inflation needle storage device comprising:

a unitary member forming a resilient, pliable and compliant base having a flat left face and a flat right face connected by an edge having a front portion formed as a curve between a top portion and a bottom portion of the edge that taper down to meet at a rear portion of said edge;

at least one inflation needle receiving hole disposed on said curve and extending into said base to create a hollow channel within said base, said hollow channel comprising an inner and outer channel, the inner channel extending from the outer channel and adapted to receive and hold a cylindrical stem of an inflation needle, and the outer channel adapted to receive and hold a threaded pipe of an inflation needle;

a concave flexible joint formed on said top edge portion, between said front and rear edge portions, which provides expansion leverage to said front edge portion curve to facilitate the expansion of each receiving hole and corresponding hollow channel in proportion to the extent of flexion of said flexible joint; and wherein pressing said front edge portion towards said bottom edge portion flexes said concave flexible joint and increases the curvature of said front edge portion curve to expand said inner and outer hollow channels to facilitate eased insertion or removal of said inflation needle cylindrical stem and threaded pipe into or from said at least one hollow channel.

7. The storage device of claim 6 wherein the base is made of plastic, rubber, or any similar resilient and pliable material.

8. The storage device of claim 6 wherein a hollow recess is incorporated into the base.

9. The storage device of claim 6, wherein said inner and outer channels are adapted to prevent the inadvertent removal of inserted inflation needles.

10. The storage device of claim 9, wherein compressing said concave flexible joint by pressing said front edge portion towards said bottom edge portion releases the hold of said outer hollow channel on the inflation needle threaded pipes.

11. The storage device of claim 6, wherein the flexibility of said concave flexible joint increases the expansion potential of said curved profile, said receiving holes and said hollow channels.

12. The storage device of claim 6, wherein said top and bottom edge portions oppose each other and extend between said front and rear edge portions which also oppose each other.

13. The storage device of claim 12, wherein said rear edge portion is a point where the top and bottom edge portions meet.

14. The storage device of claim 13, wherein pressing a first compression point located where said front edge portion curve meets said top edge portion towards a second compression point located on a compression section of said bottom edge portion spanning from a first point where the rear edge portion meets the bottom edge portion and a second point across from said first compression point flexes said concave flexible joint and increases the curvature of said front edge portion curve to expand said inner and outer hollow channels to facilitate eased insertion or removal of said inflation needle cylindrical stem and threaded pipe into or from said at least one hollow channel.

15. An inflation needle storage device comprising:

a compliant base that is a unitary piece of a uniform resilient and pliable material, said compliant base comprising a flat left face and a flat right face connected by an edge having a front portion formed with a convex curve, and top and bottom portions that taper down to a point at a rear portion of said edge;

one or more inflation needle holes formed on said convex curve and extending into said compliant base to create a hollow channel having an inner wall that abuts and encapsulates at least a first end of a needle when it is inserted into said hole;

a concave flexible joint formed on said top edge portion, between said front and rear edge portions, and having a top side beginning at an uppermost tip of the top edge portion and curving towards a bottom side positioned substantially across from the top side, that flexes when said top side is brought towards said bottom side so as to enable the expansion of said convex curve and each hole disposed thereon; and wherein pressing said uppermost tip of said top edge portion towards a compression section on said bottom edge portion spanning from a first point substantially across said uppermost tip and a second point where said bottom edge portion meets said rear edge portion urges said joint top side towards said joint bottom side and increases the curvature of said convex edge to expand each hole disposed thereon to facilitate the insertion or removal of said inflation needle into or from said at least one hollow channel, the extent of expansion of each receiving hole and corresponding hollow channel being proportional to the extent of compression of the flexible joint.

16. The storage device of claim 15 wherein the compliant base is made of plastic, rubber, or any similar resilient and pliable material.

17. The storage device of claim 15 wherein the hollow channel receives and holds the length and circumference of an inflation needle cylindrical stem.

18. The storage device of claim 15 wherein the hollow channel receives and holds the cylindrical stem and threaded portion of an inflation needle.

19. The storage device of claim 15 wherein a hollow recess is incorporated into the compliant base.

20. The storage device of claim 15, wherein said convex edge is configured to permit the receiving hole to be opened using a one-handed, two-finger operation.

* * * * *